United States Patent [19]

Summey

[11] 4,369,589

[45] Jan. 25, 1983

[54] SHOES

[76] Inventor: Walter R. Summey, 18014 Granada Ave., Fontana, Calif. 92335

[21] Appl. No.: 166,352

[22] Filed: Jul. 7, 1980

[51] Int. Cl.[3] ..... A43C 13/14; A43B 5/00

[52] U.S. Cl. ..... 36/77 R; 36/130

[58] Field of Search ..... 36/130, 77 R, 107

[56] References Cited

U.S. PATENT DOCUMENTS

| | | | |
|---|---|---|---|
| 2,795,868 | 6/1957 | Shultz | 36/77 R |
| 3,217,345 | 11/1965 | Snitzer | 36/77 R |
| 3,444,572 | 5/1969 | Broughton | 36/77 R |

*Primary Examiner*—Patrick D. Lawson

*Attorney, Agent, or Firm*—Grover A. Frater

[57] ABSTRACT

Separation of the upper from the midsole, and separation of the midsole from the main sole, of shoes resulting from the kind of forces that are applied during the practice in bowling and other sports is minimized or prevented by the use of a wrap-around member in the toe region of the shoe. The lower margin of that wrap-around member is sandwiched between the midsole and the sole of the shoe, and it is wrapped around and over the midsole and up the side of the upper where it is fastened in a way that combines with a lock stitch that binds together the wrap-around member, the midsole, and the sole so that forces that would otherwise tend to separate midsole from the upper tend, if anything, to relieve pressure on that juncture.

A cap over the toe area, the lower portion of which forms the outer margin of the main sole, has an upper portion which is included in the materials that are held together with the lock stitch whereby to protect the juncture between the wrap-around member and the sole, or the midsole and the sole, from forces that might tend to separate them.

15 Claims, 7 Drawing Figures

FIG. 1
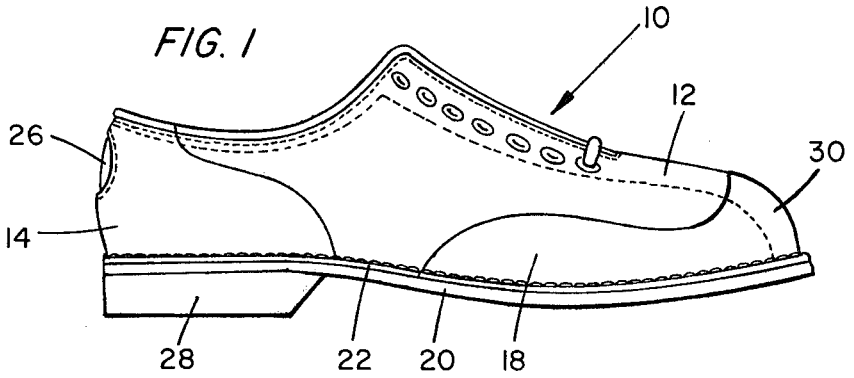
FIG. 2
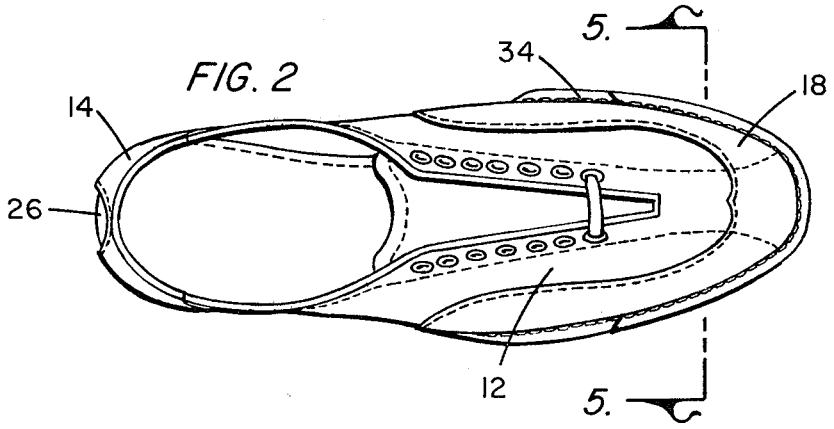
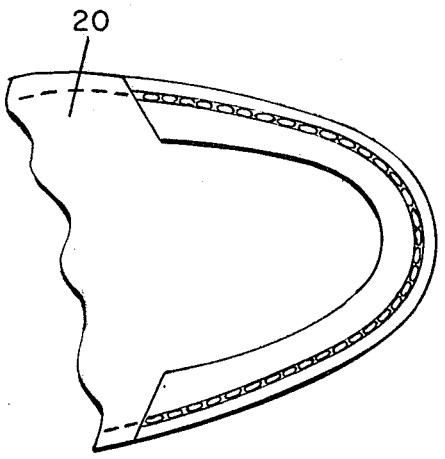
FIG. 3
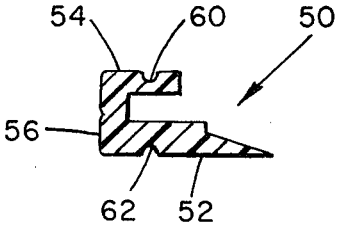
FIG. 7

SHOES

TECHNICAL FIELD

This invention relates to improvements in shoes, and it relates in particular to methods and means for preventing separation of shoe uppers from the slipsole and the slipsole from the sole.

BACKGROUND OF THE INVENTION

The problem of toe damage in shoes is often severe. Certain kinds of activities, those in which the toe end of the wearer's shoes in kicked against some article or obstacle or is dragged over the ground or floor tends to cause separation of shoe components in the region of the toe.

This problem is particularly prevalent in shoes that are worn in the conduct of sports activities. One example is socker playing. In that game, the shoe toe is used again and again to kick a ball. Another example is the sport of bowling. Bowlers usually drag the toe of one shoe over the floor as a part of throwing the ball. That practice, and the economic circumstances that attend the sport, combine to make shoe damage a major and expensive problem.

It is customary for bowlers to wear leather soled shoes similar to men's street shoes and designed to facilitate ball throwing and protection of the bowling alley and bowling alley floor area at the head of the alley. Many bowlers provide their own bowling shoes, but almost all bowling alley establishments maintain a supply of bowling shoes that patrons can rent and, lacking a suitable pair of their own, are required to rent.

The need to discourage theft, the desire to minimize the investment in a stock of shoes, and other factors combine to the end that almost all rental shoes are less than maximum quality products. Rental shoes receive hard use and the result, more often than not, is limited life because of damage in the region of the toe. The upper separates from the slipsole, the slipsole separates from the sole, or both. The former defect is the most difficult to repair.

The need to minimize the cost of bowling shoes and the low volume of bowling shoes relative to street shoes have tended to make the production of special designs economically unattractive. Men's shoe making machinery is made to produce what have become conventional shoe forms. The prospect of increased cost discourages the adoption of any design which requires the use of different machines, either at the time of original production or at the time of repair.

SUMMARY OF THE INVENTION

The need for shoe improvement is most acute in the case of rental bowling shoes. It is for that reason, and the reason that the preferred mode for practicing the invention is found in its application to bowling shoes, that the invention is described below in relation to that application.

It is a specific object of the invention to provide an improved bowling shoe and it is an object to provide an improved bowling shoe suitable for use as a rental shoe.

A more general object is to provide an improved shoe for any purpose and to provide a shoe in which separation of sole and slipsole, or midsole, from other parts of the shoe is minimized.

These and other objects and advantages of the invention which will become apparent upon a reading of the matters set out below are realized, at least in part, by the inclusion of a warp-around member which extends, in the toe area, from the region of the upper side of the midsole, around the outer edge of the midsole and then between the midsole and sole, and which is stitched to the midsole by stitches that sew together the combination of the upper part of that wrap-around member and the midsole and the lower part of that member. In a preferred form, the lower part of the wrap-around member, the midsole and the upper are joined by a McKay, or "little way," stitch. In another preferred form, the inner sole is joined by the McKay stitch.

In one form of the invention the under part of the wrap-around member forms part of the sole and is bonded, usually with an adhesive, to the remainder of the sole and/or the midsole.

Alternatively, the wrap-around member extends up along the side of the upper and is stitched to the upper. The composite is envisioned by the invention in that the wrap-around member can extend over and from the side of the upper, down to and around the midsole, and then under the midsole to form a part of the main sole.

The best form for hard rental service uses two wrap-around members. One, an upper member of relatively pliant material, overlies the upper in the region of the toe and back along the lower sides where some bowlers apply a force with the side of the foot adjacent the ball. That upper member extends down the upper to its juncture with the midsole and thence outwardly over, around and then under the midsole, there to be sewn with the little way stitch to the midsole, the upper, and to the inner sole. The other wrap-around member is formed of an abrasion resistant material that exhibits relatively low sliding friction and, in preferred form, is molded to near final shape to be placed over the upper wrap-around member in the toe region and then fastened in place. The lower member is generally U-shaped in cross section. The bottom of the U is generally vertical and lies adjacent the edge of the sole pieces. The upper arm of the U overlies that part of the upper wrap-around member that overlies the midsole. The lower part of the U underlies that part of the upper wrap-around member that underlies the midsole. At its inner margin the lower part of the U-shaped wrap-around member is bonded to the main sole. A lock stitch joins the upper arm of the U, the upper layer of the upper wrap-around member, the midsole, the lower layer of the upper wrap-around member, and the lower arm of the U. In the preferred arrangement the lock stitch lies in a groove that is molded in the lower face of the lower arm.

THE DRAWINGS

In the drawings:

FIG. 1 is a view in side elevation of a shoe in which the invention is embodied;

FIG. 2 is a top view of the shoe of FIG. 1;

FIG. 3 is a bottom view of the toe portion of the shoe of FIGS. 1 and 2;

FIG. 7 is a cross-sectional view of a wrap-around member similar to the wrap-around member shown in FIGS. 1 through 5.

DETAILED DESCRIPTION OF THE INVENTION

Figure 4:
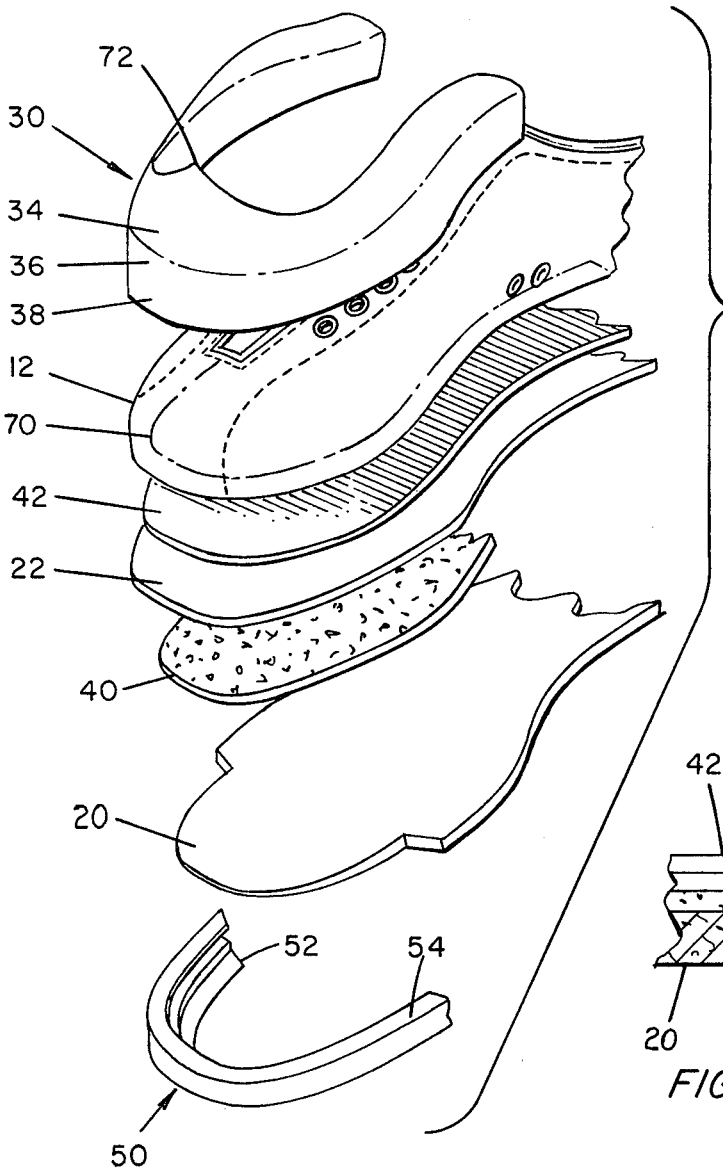
FIG. 4 is an exploded view of the toe regions of the several components of the shoe.

The shoe 10 of FIGS. 1 and 2 is the right shoe of similarly constructed pair of bowling shoes. Except for inclusion of the invention, they are representative of the kind and quality of shoe that is available for rent at bowling alley enterprises across the nation.

The upper 12 is made of leather, as is the heel counter 14, the tongue 16, what appears to be the upper wing 18, and most of the sole 20. The midsole 22 is made of a plastic material, and the inner sole 24 is made of treated paperboard. Plastisized cloth might be substituted for the leather upper and the heel piece, and it is not uncommon that the inner side and the outer side of the upper be separated at the toe. Interconnection is completed by sewing both sides to a bridging piece which may be an extension of the tongue.

Rental shoes are usually colored distinctively to discourage theft, and provision is made for attaching or otherwise applying a shoe size number to the exterior of the heel piece. A circular opening 26 in the heel marks the place where the size number is placed. In a typical case, and in this shoe, part of the upper might be colored maroon and part might be colored green. The heel 28 is made of white rubber.

The wing part 18 of the upper is not conventional. It overlies the lower surfaces of the upper instead of forming the lower part of the upper. That is shown best in FIG. 5 where the wing 18 is seen to be the upper part of a member for which the shoe art has no name and is here called a "wrap-around" member 30. From the junction of the upper 12 and the midsole 22, the wrap-around member 30. The junction of wrap-around member 30 extends outwardly over the upper surface of the midsole, then down over the outer edge of the midsole, the finally back under the midsole to a point underlying both the midsole and the lower margin 32 of the upper 12. The portion of the wrap-around member 30 that overlies the upper margin of the midsole is identified by the reference numeral 34. The portion that covers the outer edge is numbered 36, and the underlying portion is numbered 38. The underlying portion is sandwiched between the midsole and the main sole.

The space between the midsole and main sole, inside the portion 38 of the wrap-around member, is filled with a cork filler sheet 40 which is glued to the underside of the midsole. A conventional inner sole 42 overlies and is glued to the midsole at the interior of the shoe. In this embodiment, a little way stitch (the name given by the shoe industry) binds together the inner margin of portion 38 of the wrap-around member, the midsole 22, the lower margin 32 of the upper, and the inner sole. One stitch is visible in FIG. 5 where it is numbered 44.

Another stitch 46 binds the upper edge of wing 18 to the upper 12 and a lock stitch 48 binds the sole, the wrap-around member 30 and the midsole together outside of the upper. In this preferred form, a second wrap-around member 50 is included. It is preformed and serves as a cap over the portions 34, 36 and 38 of the wrap-around member 30 in the toe region of the shoe. The outer margin of the main sole is cut away and is replaced by the lower part of the cap 50.

The cap is shown in cross-section in FIG. 7. The lower section 52 serves as part of the main sole. The inner edge is wedge-shaped to match a complementary shape at the edge of the leather portion of the main sole to which it is glued. The wedge shape increases the area of the glue surface and any shape that will result in a good bond may be used. The upper part 54 of the cap is made to overlie portion 34 of member 30. The connecting part 56 of the cap abuts the vertical portion 36 of member 30. Two grooves are formed in the cap to accommodate the loops of the lock stitch. They are not visible in FIG. 5 where they are hidden by stitch 48. The upper groove 60 is formed in the upper face of upper part 54 of cap 50. Its function is to serve as a guide for the sewing needle. The primary purpose of groove 62 in the lower face of the lower part of the cap is to remove most of the stitching from the sole surface and to protect it from being worn away.

Figure 5:
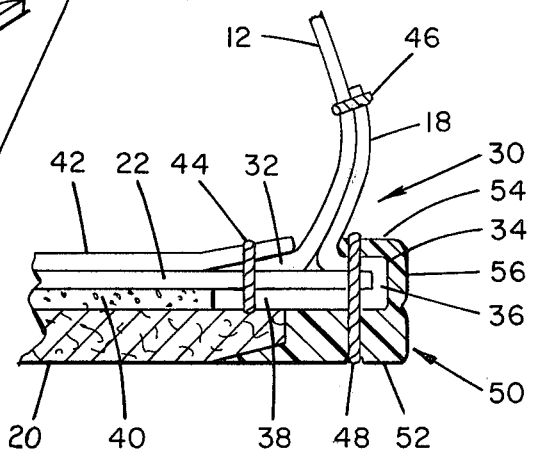
FIG. 5 is a cross-sectional view of one side of the shoe taken on line 5—5 of FIG. 2.

The manner in which the several elements of the forward part of the shoe are assembled is illustrated in the exploded view, FIG. 4. The inner sole 42 is disposed within the upper 12 and above the lower margin 32 of the upper. The lower margin is not visible in FIG. 4, but its presence is indicated by the broken line 70. The manner in which the inner sole and the upper are related is illustrated in FIG. 5. The inwardly turned lower margin 32 of the upper is glued to the upper surface of the midsole 22, and the lower surface of the inner sole is glued to the upper surface of the midsole and, at its margins, is glued to the upper surface of the lower margin 32 of the upper. In an alternative procedure, the inner sole is added at a later stage. For this preferred embodiment, it is more convenient to add it prior to addition of the wrap-around member 30 which is shown as the upper element in FIG. 4.

The lower margin of member 30 is placed upon the outer margin of the lower side of the midsole so that it extends rearwardly for a like distance on both sides of the shoe. The forward peak 72 serves as a convenient guide for properly locating that member. The inner side of the lower portion 38 of member 30 is placed against, and is secured to, the lower outer margin of the midsole. That can be done by gluing or with a little way stitch, or both. Gluing is not essential if the little way stitch is used, but the addition of a glue bonding may facilitate holding the parts together for the stitching operation. As best illustrated in FIG. 5, the little way stitch extends through the inner sole. That is not essential, but it is preferred.

The little way stitch having been completed, the wrap-around member 30 is formed around the slipsole and the upper in the manner shown in FIG. 5. In the preferred procedure, the next step is to sew the upper edge of the member 30 to the upper along its entire length. As best shown in FIGS. 1 and 2, the member 30 extends along the sides of the shoe past the ball of the foot to the instep. It is not essential that the wrap-around member extend that far to the rear of the shoe to perform its function of preventing separation between the upper sole and the midsole. Extension past the ball of the foot, however, is preferred because the addition of another layer of material adjacent the sides of the foot in the region of the ball of the foot provides additional protection against the breakage of the upper which sometimes occurs because of the force that is applied to a bowling shoe. The problem is particularly severe in the case of plastic uppers, and it is for that reason that the length of the upper wrap-around member 30 is extended in the preferred embodiment.

The next step in assembling the shoe is to add the cork filler layer 40. It is glued to the central part of the midsole, and its thickness corresponds to the thickness of portion 38 of the member 30. It is used to fill the space that would otherwise be left between the central forward area of the midsole 22 and the central forward area of the main sole 18. That spacing results because of the introduction of portion 38 of member 30 between the midsole and main sole so that the cork filler need extend rearwardly only as far as does the member 30.

The next step is to apply the chrome leather sole 18. The forward part of that leather sole has been cut away and shaped to accommodate the lower portion 52 of the cap 50. The glue is applied to the joining surfaces of the chrome leather sole and the cap, and the cap is forced into place so that its lower portion forms part of the sole and so that its upper portion 54 overlies member 30 and the midsole 22. Assembly of the cap 50 on the toe of the shoe forces the wrap-around member 50 into the V-shaped region at the juncture of the upper and the midsole in the manner depicted in FIG. 5. When the cap is in place, the lock stitch is shown to bind together the two wrap-around members and the midsole.

Figure 6:
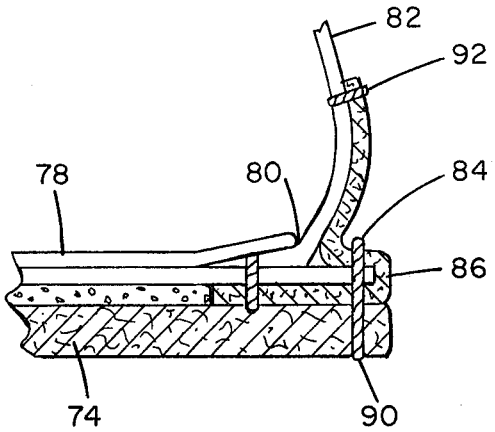
FIG. 6 is a cross-sectional view corresponding to FIG. 5 but showing an alternative form of the invention.

A modified form of the invention is illustrated in FIG. 6. This embodiment employs only the upper wrap-around member. The lower wrap-around member, the cap of FIGS. 1 through 5 and FIG. 7, is omitted. In FIG. 6, the sole 74 is conventional and it extends over the entire bottom of the shoe. The little way stitch 76 in this case does not extend through the inner sole. It extends only through the lower margin 80 of the upper 82 and the midsole 84 and the lower portion of the wrap-around member 86. The member 86 corresponds to, and may be exactly like, the wrap-around member 30 of the first described embodiment. In this case, the lock stitch 90 holds together the combination of one thickness of the member 86, the midsole 76, another layer of the wrap-around member 86, and the main sole 74. The upper margin of the wrap-around member 86 is sewn to the upper by a line of stitches one of which is shown and is numbered 92.

Cap 50 is relatively long and curved. In preferred form it is formed of a plastic material which has a relatively low coefficient of surface friction, which is scuff resistant and which can be effectively bonded with leather with a relatively inexpensive adhesive material. Rather than being made rigid, the cap is made so that it exhibits some resilience. It must bend during use, and that characteristic makes it possible to use one cap size to make a wide range of shoe sizes. The cap will cover a smaller proportion of the periphery of a large shoe than it will cover in a shoe of smaller size. The difference is small, and is accommodated by adjustment of the cutout that is formed in the chrome leather of the sole.

Except for the step of molding the cap, all of the other processes that are employed to make a shoe according to the invention correspond to processes that are already used in the shoe making industry. The shoe embodying the invention can be made with existing, conventional machinery, and nothing special is required. In the case of the modification shown in FIG. 6, there is nothing that cannot be accomplished with conventional methods and tools. However, while practicing the invention requires no special machinery or tools or skill, the result produced by the invention differs widely from the result of previous practice.

The need for the invention arises out of the fact that in certain applications a force is applied to the upper surface of a midsole in a direction to tear it away from the upper of the shoe. In the past, the answer to that problem has been to increase the strength of the bond between the lower margin of the upper and the midsole. That approach has been seen as both logical and direct. The little way stitch is made heavier, and the glue bond is made stronger. Certainly those effects have contributed to a reduction in the instances of midsole and upper separation. What Applicant has done provides a better and more effective solution to the problem because it uses forces applied to the upper side of the midsole at the exterior of the shoe to relieve and to prevent the imposition of forces that would tend to separate the lower margin of the upper from the midsole. That is done by transmitting that force through the wrap-around member to the point at which the wrap-around member is stitched to the upper at a point well removed from the junction of the lower margin of the upper and the midsole. That same action occurs in the embodiments of FIGS. 5 and 6, although it may be easier to envision it in connection with FIG. 6. The strain is taken by the lock stitch rather than by the little way stitch. Extending the wrap-around member down around the midsole and then under it prevents the application of upward forces to the wrap-around member which would tend to separate it from the midsole. Finally, extension of the lower portion of the wrap-around member under the lower margin of the upper provides an opportunity to include it in the material layers that are joined by the little way stitch to the end that that bond is strengthened.

In the absence of the wrap-around member, there are two junctures that are exposed to the exterior of the shoe where they can be exposed to forces tending to separate them. One of those junctures occurs at the interface of the midsole and the main sole, and the other occurs at the juncture of the midsole and the upper. Addition of the wrap-around member eliminates the latter. Only the juncture between the wrap-around member and the sole remains exposed. The inner connection between the wrap-around member and the upper occurs at a point where separating forces are rarely applied, and are not applied in the ordinary use of a bowling shoe. Because the main stitch is more effective in its bonding task than is the little way stitch (because the lower end of the upper is so thin), addition of the one wrap-around member, as illustrated in FIG. 6, solves most of the problem. Addition of the cap in the preferred embodiment eliminates the juncture between the midsole and the main sole, or between the upper wrap-around member and the main sole. Drag his toe as he will, the bowler simply cannot pull the main sole from the midsole. Inclusion of the upper portion, part 54 of the cap 50, permits a forcing of the upper wrap-around member into the V-shaped space at the juncture of the upper and the midsole in a way that aids the transfer of downward forces in the direction of the upper side of the midsole, to the stitch 46 in FIG. 5. At this point, attention is invited to the toe end of FIG. 1, at the very front of the shoe where the forces are greatest that tend to separate the shoe. Here, the wrap-around member 30 is extended to a point relatively high on the toe. Because of that, forces applied to the member 30, as a consequence of downward force at the very front of the shoe, need not be borne entirely by the stitching of the wrap-around member and the upper.

Frictional engagement of the wrap-around member with the forward part of the upper results in a distribution of those forces over a relatively wide area. There is, in fact, no need for the stitching between the wrap-around member and the upper to be any heavier or stronger than what is normally used in the construction of conventional shoes.

Although I have shown and described certain specific embodiments of my invention, I am fully aware that many modifications thereof are possible. My invention, therefore, is not to be restricted except insofar as is necessitated by the prior art.

I claim:

1. In a shoe of the type that has an interconnected upper, midsole, and sole and in which the midsole and sole extend beyond the upper in the region of the toe of the shoe, the improvement which comprises the addition of a wrap-around member in the region of the shoe's toe in the form of an element which is fastened to the upper at a point above its junction with the midsole and which extends over and under the midsole to a position between the midsole and the main sole; and said wrap-around member extending over, around and under the outer margin of said midsole and being fastened to both the upper and the lower faces of said midsole.

2. The invention defined in claim 1 in which the lower edge of the upper, the midsole and the underlying portion of the wrap-around member are fastened together with McKay stitching.

3. The invention defined in claim 1 which further comprises means in the form of a cap part of which overlies a part of said wrap-around member and said midsole and part of which underlies a part of said wrap-around member and said midsole for binding said wrap-around member to said midsole.

4. The invention defined in claim 3 in which that part of said cap which underlies said midsole and wrap-around member forms part of said sole.

5. The invention defined in claim 1 in which said wrap-around member extends around the toe region and rearwardly on both sides of said shoe to the ball area of said shoe.

6. In a shoe of the type that has an interconnected upper, midsole, and sole the improvement which comprises the addition of a wrap-around member in the region of the shoe's toe in the form of an element which is fastened to the upper at a point above its junction with the midsole and which extends over and under the midsole to a position between the midsole and the main sole;

said wrap-around member extending over, around and under the outer margin of said midsole and being fastened to both the upper and the lower faces of said midsole; and the portion of said wrap-around member which extends over and under said midsole, and said midsole being joined by stitching to said main sole.

7. In a shoe a sole, a midsole connected to the sole, and an upper connected to the midsole, the outer edges of the midsole extending beyond the upper in the region of the toe region of the shoe; and means in the form of a cap which extends from the sole up and over the outer edges of the midsole in the toe region of the shoe for covering the edges of the midsole in the toe region.

8. The invention defined in claim 7 in which said cap is generally U-shaped in central vertical cross-section.

9. The invention defined in claim 7 in which the cap forms a part of the sole at the outer margins of the sole in the region of the toe.

10. The invention defined in claim 9 in which said cap is formed of plastic and is resilient.

11. The invention defined in claim 9 in which the sole is tapered to reduced thickness in the region of the toe and in the direction toward the front of the toe of the shoe and in which the portion of the cap which forms a part of the sole underlies the tapered portion of the sole and is tapered to reduced thickness in the direction away from the front of the toe of the shoe.

12. The invention defined in claim 7 which further comprises a wrap-around member having a lower margin fixed between said sole and said midsole and having a portion extending from said lower margin up and over the outer edge of said midsole to an upper portion of the wrap-around member which upper portion is fixed to said upper.

13. The invention defined in claim 12 in which the cap forms a part of the sole at the outer margins of the sole in the region of the toe.

14. The invention defined in claim 13 in which said cap is formed of plastic and is resilient.

15. In a bowling shoe, a midsole connected to the sole, and an upper connected to the midsole;

means in the form of a cap which extends from the sole up and over the outer edges of the midsole in the toe region of the shoe for covering the edges of the midsole in the toe region;

said cap forming a part of the sole at the outer margins of the sole in the region of the toe;

said cap being formed of plastic and being resilient;

said cap being formed with a stitch receiving channel formed in the outer surface of the portion that serves as part of the sole; and said cap being secured to said midsole with stitches that lie in said channel.

* * * * *